US006180259B1

(12) United States Patent
Harada et al.

(10) Patent No.: US 6,180,259 B1
(45) Date of Patent: Jan. 30, 2001

(54) SPRAY COATED MEMBER RESISTANT TO HIGH TEMPERATURE ENVIRONMENT AND METHOD OF PRODUCTION THEREOF

(75) Inventors: Yoshio Harada; Tatsuo Suizu; Takema Teratani, all of Hyogo (JP)

(73) Assignee: Tocalo Co., Ltd., Hyogo (JP)

( * ) Notice: Under 35 U.S.C. 154(b), the term of this patent shall be extended for 0 days.

(21) Appl. No.: 09/147,290

(22) PCT Filed: Mar. 23, 1998

(86) PCT No.: PCT/JP98/01239

§ 371 Date: Nov. 20, 1998

§ 102(e) Date: Nov. 20, 1998

(87) PCT Pub. No.: WO98/42888

PCT Pub. Date: Oct. 1, 1998

(30) Foreign Application Priority Data

Mar. 24, 1997 (JP) ..... 9-088823

(51) Int. Cl.[7] ..... B32B 15/00; C23C 4/10; C23C 4/08

(52) U.S. Cl. ..... 428/615; 428/632; 428/633; 428/668; 428/678; 428/679; 427/453; 427/455; 427/456

(58) Field of Search ..... 428/615, 632, 428/633, 668, 678, 679, 937; 427/446, 453, 455, 456

(56) References Cited

U.S. PATENT DOCUMENTS

| | | | | |
|---|---|---|---|---|
| 3,754,903 | * | 8/1973 | Goward et al. | 75/171 |
| 4,687,678 | | 8/1987 | Lindblom . | |
| 5,082,741 | * | 1/1992 | Taira et al. | 428/469 |
| 5,277,936 | * | 1/1994 | Olson et al. | 427/453 |
| 5,397,649 | * | 3/1995 | Schiente et al. | 428/552 |
| 5,455,119 | | 10/1995 | Taylor et al. . | |
| 5,912,087 | * | 6/1999 | Jackson et al. | 428/610 |

FOREIGN PATENT DOCUMENTS

| | | |
|---|---|---|
| 55-104471 | 8/1980 | (JP) . |
| 56-51567 | 5/1981 | (JP) . |
| 61-10034 | 3/1986 | (JP) . |
| 3-207849 | 9/1991 | (JP) . |
| 4-323357 | 11/1992 | (JP) . |
| 98/42887 | 10/1998 | (WO) . |

OTHER PUBLICATIONS

English Language Abstract of JP No. 3–207849.
English Language Abstract of JP No. 4–323357.
English Language Abstract of JP No. 55–104471.
English Language Abstract of JP No. 56–51567.

* cited by examiner

*Primary Examiner*—Timothy M. Speer
*Assistant Examiner*—Bryant Young
(74) *Attorney, Agent, or Firm*—Greenblum & Bernstein, P.L.C.

(57) ABSTRACT

In order to advantageously solve problems such as lowering of the productivity, contamination of alloy coating due to the adoption of different metal, increase of the cost due to the adoption of different coating process, a coating of MCrAlX alloy containing an oxide such as CoO, NiO or the like is directly formed at a thickness of 10~500 μm through a low pressure plasma spraying process containing substantially no oxide and thereafter the same MCrAlX alloy xontaining no oxide is applied thereonto at a thickness of 100~800 μm through a low pressure plasma spraying process in a non-oxidizing atmosphere to form a composite sprayed coating.

20 Claims, 2 Drawing Sheets

SPRAY COATED MEMBER RESISTANT TO HIGH TEMPERATURE ENVIRONMENT AND METHOD OF PRODUCTION THEREOF

TECHNICAL FILED

This invention relates to a spray coated member for use in high-temperature environment having an excellent high-temperature oxidation resistance as a high-temperature member such as boiler, gas turbine, jet engine, diesel engine or the like and a method of producing the same.

BACKGROUND ART

As to a high power generator such as a boiler, a gas turbine, a jet engine, a diesel engine or the like, there are many studies for mainly improving a heat efficiency. However, the improvement of heat efficiency forces a severe thermal load to a constructional part (material). As a metallic material used in a high temperature portion of the high power generator, therefore, it is required to have excellent high-temperature oxidation resistance and high-temperature corrosion resistance. Particularly, if it is intended to use a fuel containing impurities such as V, Na, S and the like, since inorganic compounds containing these impurities violently corrode and wear the metallic material at a high-temperature state, it is necessary to maintain the metallic material at a stable state for a long time under such an environment.

In order to satisfy such a requirement, there have been developed many heat resistant alloys consisting essentially of nonferrous metallic elements such as Cr, Ni, Mo, Co, W, Ta, Al, Ti and the like from the old time, which are called as so-called super-alloys.

In these heat resistant alloys, however, the high-temperature strength is most preferential, so that it tends to suppress an addition amount of a metal element not serving to the improvement of the strength as low as possible. A typical example of the metal element not serving to the improvement of the strength is Cr, Al, Si or the like, but these elements are excellent in the oxidation resistance and resistance to high-temperature corrosion. Therefore, it is ordinary that the super-alloy preferentially requiring the above high temperature strength is poor in the oxidation resistance and resistance to high-temperature corrosion.

Heretofore, a metallic elements such as Cr, Al, Si or the like or an alloy thereof has previously been applied to a surface of a super-alloy member used under a high temperature environment through a spraying process, a diffusion treatment method or the like to compensate for the lowering of resistance force to chemical damage of the super-alloy.

In the conventional spraying process, it is merit that the kind of the spraying material may optionally be selected, but there is a drawback that the resulting coating is porous and is poor in the corrosion resistance and adhesion property because the treatment is carried out in air.

In this connection, there has recently been developed a method wherein plasma spraying is carried out in an argon gas atmosphere of a low pressure containing substantially no air (oxygen) (low-pressure plasma spraying process), whereby drawbacks inherent to the atmospheric-sprayed coating have largely been improved, but it can not be said that such a coating is still sufficient under recent environment exposed at higher temperature.

On the other hand, the conventional diffusion treatment method is relatively easy when Cr, Al, Si and the like are treated individually, but it is hardly said that the oxidation resistance and the resistance to high-temperature corrosion are sufficient. And also, this treatment is required to be conducted at a higher temperature state of about 1000° C., so that it has a drawback that mechanical properties of super-alloy matrix lower.

Under the above circumstances, JP-A-55-104471 proposes a method wherein Ni—Cr alloy as an oxidation-resistant metal is sprayed to conduct a diffusion treatment of Al, Cr or the like.

In this method, however, the treatment at high temperature can not be avoided, so that it is inevitable to lower the mechanical properties of the matrix though the adhesion property and denseness of the sprayed coating are improved.

On the other hand, the development of spraying materials is carried out for using under high-temperature environment. A typical material is a heat-resistant alloy material represented by MCrAlX (wherein M is a metal of Ni, Co or Fe or a mixture thereof. X is an element such as Y, Hf, Ta, Cs, Pt, Ce, Zr, La, Si, Th or the like). By plasma spraying the MCrAlX alloy under a low pressure, it is possible to form a sprayed coating having excellent oxidation resistance and resistance to high-temperature corrosion, and the performances of the high-temperature member are more improved. And also, there is proposed a method wherein the diffusion treatment of Cr, Al or the like is conducted after the formation of the MCrAlX alloy sprayed coating (e.g. JP-B-61-10034).

The service life of the member for gas turbine is fairly improved by the above recent spraying process or the development of a technique combining the spraying process and the diffusion treatment method. However, the gas temperature of the gas turbine is anticipated to reach 1500~1700° C. in future.

In the gas turbine member contacting with such a high temperature gas, even if it is reinforced with a cooling mechanism through air or steam, it is anticipated that the temperature of the exposed member exceeds the existing 900° C. and will be 950~1050° C. For this end, it is studied to improve the high temperature strength of the member for the gas turbine (metal matrix).

However, when the alloy sprayed coating is formed on such a high temperature member (metal substrate) by the conventional method, there is a fear of causing the following problems.

(1) In the high temperature member (metal substrate), as the temperature becomes high, there is a strong tendency that an alloy component in a sprayed coating of, for example, MCrAlX alloy (wherein M is one or more of Ni, Co and Fe, X is one or more of Y, Hf, Ta, Cs, Pt, Ce, Zr, La, Si and Th) formed on the surface or a composite sprayed coating containing a diffusion layer therein diffuses and penetrates into the inside of the metal substrate and hence a thick brittle layer is created in a boundary portion between the sprayed coating and the substrate surface to easily peel the sprayed coating.

(2) Among the components of the MCrAlX alloy penetrated into the inside of the metal substrate, Al particularly reacts with Ni included in the metal substrate to produce a brittle intermetallic compound such as AlNi, AlCo or the like and has an action disappearing a high temperature strength component or precipitate existing in the substrate. As a result, the high temperature strength of the substrate as a whole lowers and it is apt to cause crack or local breakage resulted from thermal fatigue.

(3) Even in the MCrAlX alloy sprayed coating, Ni, Cr and the like being basic components diffuse to form a brittle layer, so that the resistance to thermal shock in the coating considerably lowers.

It is said that these problems result from the feature that the components of the MCrAlX alloy sprayed coating applied to the surface of the substrate diffuse and penetrate into the substrate. As a countermeasure therefor, it is considered that the prevention of diffusing and penetrating the alloying components of the sprayed coating is an effective means.

As such a means, there is a method wherein a high melting point metal (Nb, Ta) or a thin layer of (10~100 μm) of an oxide film such as $Al_2O_3$ is directly formed on the surface of the substrate through a spraying method or PVD method and the conventional MCrAlX alloy sprayed coating is formed thereon to control the internal diffusion of the MCrAlX alloying components.

In this method, however, an expensive metal different from the MCrAlX alloying components is used, or the PVD method using an electron beam as a heat source is used in the formation of $Al_2O_3$ film, so that the different film-forming process should be adopted and hence the lowering of the productivity is caused.

And also, the prevention of the internal diffusion of the alloying components by this method loses the diffusion layer required for ensuring the adhesion property between the substrate and the sprayed coating and the adhesion property of the coating considerably lowers.

It is, therefore, an object of the invention to solve the aforementioned problems of the conventional techniques and to propose a coating technique for advantageously solving problems such as lowering of productivity, contamination of alloy coating based on the adoption of different metal, cost up based on the adoption of different coating process and the like.

DISCLOSURE OF THE INVENTION

The invention does not lie in a method adopting a different film-forming means and using a different metal as in the conventional technique, but lies in a technique forming a coating having an excellent resistance to high-temperature oxidation by using same film-forming means, same metal and same metal oxide.

That is, the invention is a technique based on the following thoughts.

(1) To prevent that the components in the MCrAlX alloy sprayed coating formed on the surface of the member exposed to high temperature rapidly diffuse into the inside of the substrate through with the rise of temperature in the gas turbine.

(2) To maintain good mechanical properties over a long time by preventing the formation and growth of a modified layer having poor mechanical strength and low strength to thermal strength on the surface of high temperature substrate.

(3) To eliminate an adoption of a different film-forming method such as formation of $Al_2O_3$ underlayer thin film through PVD process or the like and formation of MCrAlX alloy sprayed coating through spraying process.

(4) To eliminate the necessity of spraying a different high-melting point metal such as Nb, Ta or the like as an undercoat prior to the spraying of MCrAlX alloy.

(5) To eliminate the degradation of resistance to high-temperature oxidation resulted from the metal such as Nb, Ta or the like included in the MCrAlX alloy when the cleaning in the line is insufficient.

(6) In the conventional technique, the thin film such as $Al_2O_3$, Nb, Ta or the like formed as a lower layer is apt to bring about the lowering of the adhesion property of the MCrAlX alloy coating as an upper layer, so that it is difficult to form the film (when the internal diffusion of the MCrAlX alloy is prevented by $Al_2O_3$ or the like, it is apt to cause the peeling due to the lowering of the adhesion property, while when the adhesion property is improved, the diffusion of the alloy into the inside of the substrate becomes deeper, which results in the lowering of the mechanical properties of the substrate itself). In the invention, the film can be formed by a simple method without requiring the above complicated control.

The invention developed under such thoughts is as follows.

(1) It is a composite sprayed coating formed by directly applying a MCrAlX alloy containing an oxide such as CoO, NiO or the like on a surface of a substrate of a high-temperature exposed member at a thickness of 10~500 μm through a low pressure plasma spraying process in the substantial absence of oxygen and then applying the same MCrAlX alloy containing no oxide thereon at a thickness of 100~800 μm through a low pressure plasma spraying process in a non-oxidizing atmosphere.

(2) The oxide powder to be mixed with the MCrAlX alloy is used in an amount of 0.2~20 wt % and the mixture is sprayed in a non-oxidizing atmosphere to form an undercoat having a thickness of 10~500 μm onto the substrate of a high-temperature exposed member and then the MCrAlX alloy containing no oxide is sprayed thereonto in a non-oxidizing atmosphere to form a topcoat having a thickness of 10~800 μm.

(3) An Al diffusion is carried out on at least one surface of the sprayed coatings formed by the method of the item (1) or (2) to further provide a high resistance to high-temperature oxidation.

(4) A heat shielding layer made of an oxide ceramic is further formed on the surface of the topcoat sprayed coating.

That is, the invention lies in a spray coated member for a resistance to a high-temperature environment characterized by having a composite sprayed coating comprised of an oxide-containing undercoat sprayed coating obtained by spraying a MCrAlX alloy spraying material containing one or more oxide powder selected from the group consisting of CoO, NiO, $Cr_2O_3$, $Al_2O_3$, $Y_2O_3$, MgO, $SiO_2$, $ZrO_2$ and $TiO_2$ onto a surface of a heat-resistant alloy substrate under a low pressure and in the substantial absence of oxygen oxide and a non-oxide topcoat sprayed coating obtained by spraying a MCrAlX alloy spraying material onto the undercoat under a low pressure containing substantially no oxygen.

In the invention, it is preferable that the composite sprayed coating is further provided with a heat shielding layer made of an oxide ceramic formed on the surface of the topcoat sprayed.

In the invention, it is preferable that a total amount of the oxide powders included in the undercoat sprayed coating is within a range of 0.2~20% by weight. And also, so-called inclination compounding is favorable so as to gradually increase the compounding amount toward the substrate.

In the invention, it is preferable that a Al diffused layer is provided on the surface side of the undercoat and/or the topcoat.

In the invention, it is preferable that the undercoat sprayed coating has a thickness of 10~500 μm and the topcoat sprayed coating has a thickness of 100~800 μm.

Further, the invention is a method of producing a spray coated member for a resistance to high-temperature environment, characterized in that ① an oxide-containing undercoat sprayed coating is formed by spraying a mixture of a MCrAlX alloy (wherein M is one or more of Ni, Co and Fe and X is one or more of Y, Hf, Ta, Cs, Pt, Ce, Zr, La, Si and Th) and one or more oxides selected from the group consisting of CoO, NiO, $Cr_2O_3$, $Al_2O_3$, $Y_2O_3$, MgO, $SiO_2$, $ZrO_2$ and $TiO_2$ onto a surface of a heat-resistant alloy substrate through a spraying process under a low pressure and in the substantial absence of oxygen and ② then a non-oxide topcoat sprayed coating is formed thereon as a composite sprayed coating by spraying a MCrAlX alloy (wherein M is one or more of Ni, Co and Fe and X is one or more of Y, Hf, Ta, Cs, Pt, Ce, Zr, La, Si and Th) under a low pressure containing substantially no oxygen through a film-formable spraying process.

In the invention, it is preferable that after the formation of the undercoat and/or the topcoat, Al diffusion treatment is further carried out on the surface of at least one coatings to increase the Al concentration in the surface layer portion of each coating.

In the invention, it is preferable that in the formation of the composite sprayed coating, an oxide ceramic is further sprayed after the formation of the topcoat to form a heat shielding layer.

BEST MODE FOR CARRYING OUT THE INVENTION

Figure 1:
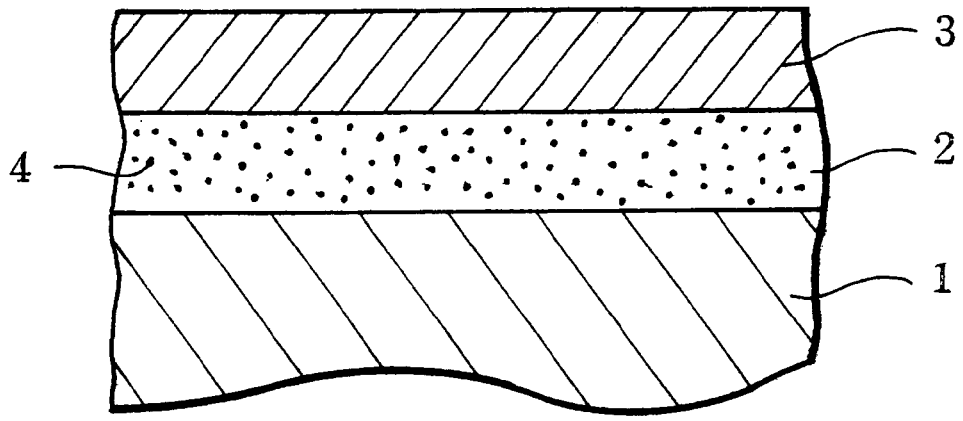
FIG. 1 is a partial diagrammatic view of a sectional structure in a spray coated member according to the invention.

The invention proposes a composite coating of MCrAlX alloy having a good adhesion property and an excellent resistance to high-temperature oxidation though an amount of diffusion into an inside of a substrate and a surface coating method thereof. The details of the structure of the composite coating will be described below.

A. Undercoat MCrAlX alloy sprayed coating and the formation thereof;

As a substrate to be treated, there is used Ni-based alloy, Co-based alloy or the like frequently used as a gas turbine blade. The surface of the substrate is degreased and roughened by blast treatment. Thereafter, a mixture of MCrAlX alloy and one or more oxides selected from the group consisting of ① oxides of MCrALX alloy; CoO, NiO, $Cr_2O_3$, $Al_2O_3$, $Y_2O_3$ and ② other oxides; MgO, $SiO_2$ $ZrO_2$ and $TiO_2$ is applied at a thickness of 10~500 $\mu$m in a non-oxidizing atmosphere containing substantially no oxygen to form an undercoat coating.

The particle size of the above oxide powder is preferable to be within a range of 0.1~50 $\mu$m and also the amount added to the above MCrAlX alloy is within a range of 0.2~20 wt %. When the particle size is less than 0.1 $\mu$m, the oxide frequently evaporates in a heat source for the spraying, while when it exceeds 50 $\mu$m, the fusion is difficult and the oxide is entered into the undercoat at a non-fused state and hence the coating is brittle and is apt to cause cracking.

As to the addition amount of the oxide powder, when it is less than 0.2 wt %, the diffusion reaction of the MCrAlX alloy coating components into the inside of the substrate can not sufficiently be controlled if the member to be treated is exposed to a higher temperature, while when it exceeds 20 wt %, the diffusion amount into the inside of the substrate becomes small and the adhesion property of the alloy coating undesirably lowers.

Moreover, the oxide powder added to the MCrAlX alloy can be produced by mechanically mixing (e.g. mechanical alloying process), or by granulating them with a tacking agent, or by a method wherein the oxide powder is mixed with molten alloy and then pulverized, or the like.

As seen from the above, in the invention, the oxide powder is included in the undercoat sprayed coating formed on the surface of the substrate. As a property of this sprayed coating, the components of the MCrAlX alloy particles diffuse into the inside of the substrate, but the oxide powder does not diffuse. Therefore, it is said that the diffusion into the inside of the substrate becomes small as the oxide powder in the undercoat becomes large.

According to the invention, in the formation of the undercoat sprayed coating of the oxide-containing MCrAlX alloy, it is favorable to conduct so-called slant concentration compounding of the oxide powder in such a manner that the content of the oxide powder is large in the side of the substrate and is made small in the surface layer portion. This is due to the fact that the undercoat sprayed coating having the slant compounded concentration of the oxide powder can effectively control the diffusion of the MCrAlX alloy components into the inside of the substrate and also is excellent in the adhesion property to the topcoat.

As to the sprayed coating of the oxide-containing MCrAlX alloy for the undercoat, there are the following some problems from a viewpoint of the resistance to high-temperature oxidation.

① The oxide powder and MCrAlX alloy particles existing in the undercoat sprayed coating are not fused to each other at a state of forming the coating, so that microscopic gaps are produced.

② The corrosive components in the environment (corrosive components in combustion gas) penetrate into the inside of the coating through the microscopic gaps to lower the resistance to high-temperature oxidation in the coating. As a countermeasure, the invention may adopt the following means.

(a) The surface of the undercoat sprayed coating of the oxide-containing MCeAlX alloy is subjected to Al diffusion treatment.

(b) The MCrAlX alloy coating containing no oxide is further formed on the surface of the undercoat sprayed coating of the oxide-containing MCrAlX alloy through a low pressure plasma spraying process.

As to the Al diffusion treatment to the surface of undercoat sprayed coating of MCrAlX alloy containing oxide powder; As previously mentioned, the oxide powder and the MCrAlxalloy particles are not fused to each other, so that the resulting coating is poor in the resistance to high-temperature oxidation as it is. In the invention, therefore, the undercoat sprayed coating is subjected to the Al diffusion treatment, whereby the fusion of the oxide powder and the MCrAlX alloy particles is attempted on the surface but also the Al content is increased to improve the resistance to high-temperature oxidation.

As a process for the Al diffusion treatment, use may be made of a powder process (the member to be treated is embedded in powder made from Al metal, Al alloy powder, $Al_2O_3$, halide or the like and heated at 900~1100° C. for 3~10 hours), a chemical deposition process (metallic Al is precipitated by thermal decomposition of organic or inorganic Al compound or reduction reaction thereof with hydrogen and adhered onto the surface of the member to be treated), a physical deposition process (Al is evaporated by heat source such as electron beam or the like and adhered onto the surface of the member to be treated) and the like.

The surface of the undercoat sprayed coating subjected to the Al diffusion treatment is excellent in the resistance to high-temperature oxidation and can be used as it is in accordance with the use environmental conditions.

When the sprayed coating of the MCrAlX alloy containing the oxide as mentioned above is applied onto the surface of the substrate as an undercoat, even if the temperature of the use environment is not lower than 1000° C., the above oxide obstructs the diffusion of the MCrAlX alloy and hence the excessive diffusion into the inside of the substrate is eliminated. However, the oxide existing in the sprayed coating of the MCrAlX alloy is ununiformly distributed and the properties of the oxide itself become frequently incomplete state as compared with those of a stoichiometric oxide due to the flying in th eplasma heat source. On the other hand, many particles not oxidized are existent in the alloy.

The thickness of the undercoat sprayed coating is within a range of 10~500 μm, preferably a range of 50~100 μm. When it is less than 10 μm, it is difficult to form the coating at an equal thickness by the spraying process, while when it exceeds 500 μm, the function as the diffusion obstruction is not improved and it is not economical.

Therefore, when such a sprayed coating is heated to a higher temperature, the diffusion into the inside of the substrate somewhat occurs. In the invention, the topcoat is formed on the undercoat by spraying the MCrAlX alloy containing no oxide through a spraying process containing substantially no oxide as mentioned below.

B. Topcoat MCrAlX alloy sprayed coating and the formation thereof;

The undercoat sprayed coating of the MCrAlX alloy containing the oxide is small in the diffusion rate into the inside of the substrate, but is weak in the bonding force between the particles constituting the coating as it is and is porous, so that when it is used under an operating environment of gas turbine at a high temperature, there is caused a problem that the member to be treated (e.g. a turbine blade) is oxidized at a high temperature or subjected to a high-temperature corrosion by a combustion gas component invaded from pores of the coating.

In order to solve this problem, according to the invention, a topcoat sprayed coating of MCrAlX alloy containing no oxide is further formed on the surface of the undercoat sprayed coating or the undercoat sprayed coating subjected to the Al diffusion treatment by a low pressure plasma spraying process in a non-oxidizing atmosphere. The topcoat sprayed coating is strong in the bonding force between the particles and good in the adhesion property to the undercoat sprayed coating.

After the formation of the topcoat sprayed coating, when the heat treatment is carried out in air or argon atmosphere or under vacuum at 1000~1170° C. for 1~5 hours, the pores of the topcoat sprayed coating are completely disappeared, whereby the resistance to high-temperature oxidation and the resistance to high-temperature corrosion can sufficiently be improved.

In a preferable embodiment, the surface of the coating after the formation of the topcoat sprayed coating is subjected to the same Al diffusion treatment as mentioned above, whereby a layer of a high Al concentration having an excellent oxidation resistance is formed on the outermost surface layer portion of the topcoat sprayed coating and also a stronger bonding force between the particles constituting the topcoat is developed.

As the Al diffusion treatment, the same process as mentioned above may be adapted.

The thickness of the topcoat sprayed coating is within a range of 100~800 μm, preferably a range of 200~500 μm. When it is less than 100 μm, the resistance to high-temperature oxidation is insufficient, while when it exceeds 800 μm, the performances as the coating are not extremely improved and it is uneconomical.

Although the formation of the undercoat sprayed coating and the topcoat sprayed coating is described by taking the low pressure plasma spraying process, the following process can be adopted as seen from the function and mechanism. That is, the low pressure plasma spraying process conducting the film formation in an atmosphere containing substantially no oxygen is optimum, but a pressure plasma spraying process or a spraying process using a laser as a heat source may be used if the atmosphere contains substantially no oxygen. And also, it can be said that it is possible to form the coating by a deposition process using an electron beam as a heat source in a vacuum vessel.

Now, the chemical components of the sprayed coating used in the invention are called as a MCrAlX alloy as mentioned above, and a typical composition of the alloy is shown below.

M component: Ni (0~75 wt %), Co (0~70 wt %), Fe (0~30 wt %)

Cr component: 5~10 wt %

Al component: 1~29 wt %

X component: Y (0~5 wt %), Hf (0~10 wt %)

In the invention, Ta (1~20 wt %), Si (0.1~14 wt %), B (0~0.1 wt %), C (0~0.25 wt %), Mn (0~10 wt %), Zr (0~3 wt %), W (0~5.5 wt %), Cs, Ce, La (0~5 wt %, respectively), Pt (0~20 wt %) and the like may be added, if necessary, in addition to the above components.

Moreover, in the invention, the heat shielding layer formed on the surface of the topcoat sprayed coating is preferably an oxide ceramic mainly composed of ZrO2 and added with 4~30 wt % of one or more of Y2O3, CaO, MgO, CeO2 and the like for stabilization or partial stabilization of ZrO2 crystal, or MgO—$Al_2O_3$, ZrO2—Al2O3 or the like may be used.

FIG. 1 diagrammatically shows a sectional structure of a basic composite sprayed coating according to the invention, in which an undercoat 2 of oxide-containing MCrAlX alloy is formed on a member 1 to be treated through a low pressure plasma spraying process and a topcoat 3 of MCrAlX alloy is formed thereon through a low pressure plasma spraying process.

Figure 2:
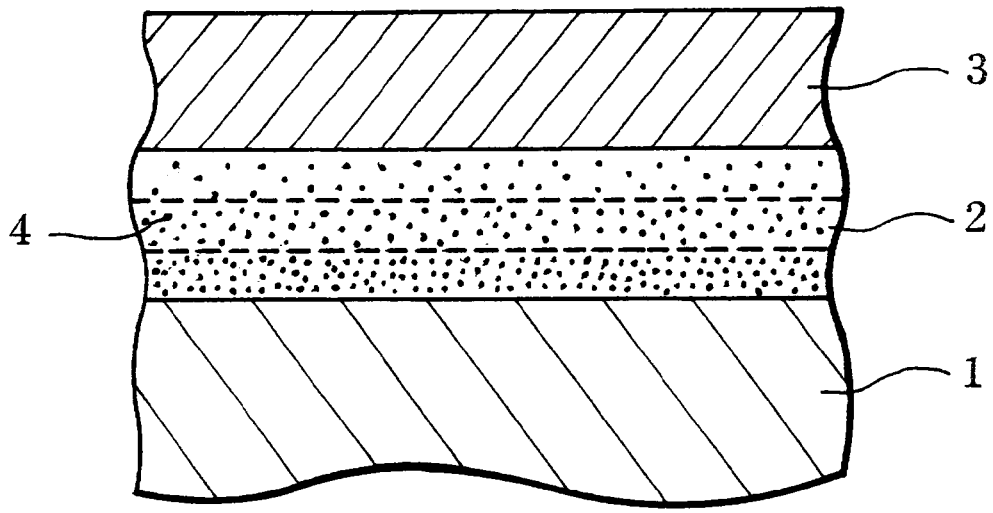
FIG. 2 is a partial diagrammatic view of a sectional structure in another composite spray coated member according to the invention.

Further, FIG. 2 shows a sectional structure of the coating when the content of the oxide powder in the undercoat sprayed coating is slantly changed. When any coatings are exposed to a high-temperature environment, the oxide powder included in the undercoat sprayed coating controls the excessive diffusion of the MCrAlX alloy coating components into the inside of the member to be treated, while the dense topcoat sprayed coating develops the action of preventing the invasion of corrosive gas from an exterior.

Figure 3:
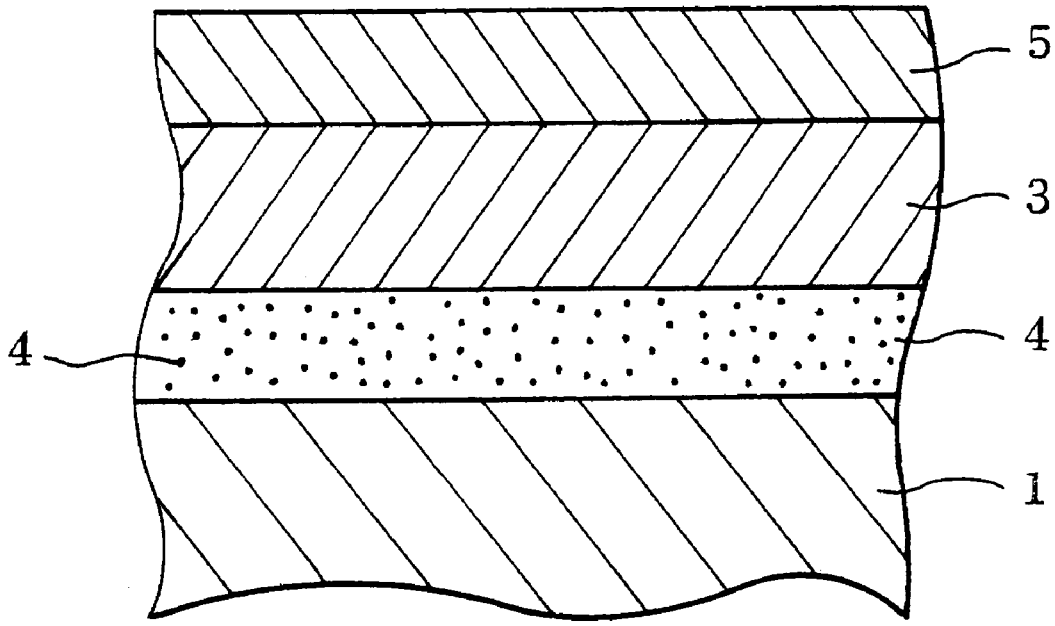
FIG. 3 is a partial diagrammatic view of a sectional structure in the other composite spray coated member according to the invention.

For this end, as shown in FIG. 3, when the heat shielding layer of ZrO2 oxide ceramic partly stabilized with CaO, MgO, Y2O3, CeO2 or the like is formed on the aurface of the topcoat sprayed coating, the exposed temperature of the member to be treated can be lowered and the internal diffusion rate of the undercoat can be further decreased.

EXAMPLES

Example 1

In this example, there are compared depths of diffusion layers into an inside of a Ni-based alloy substrate in composite sprayed coating according to the invention, which is formed on the surface of the Ni-based alloy substrate and consists of an undercoat sprayed coating of an oxide-containing MCrAlX alloy formed through a low pressure plasma spraying process and a topcoat sprayed coating of MCrAlX alloy formed through a low pressure plasma spraying process.

And also, various kinds of the MCrAlX alloy spraying materials are used in the following examples and chemical compositions thereof are shown in Table 1. That is, the spraying materials can be roughly divided into an alloy spraying material containing no Ni (A), alloy spraying material containing no Co (B, C, D, E), alloy material containing Ni and Co (F, G) and a material obtained by adding 5 wt % of Ta, which is not included in the other alloys, to the alloy G.

A. Test specimens:

The Ni-based alloy (15.3 wt % Ni-7 wt % Fe-2.5 wt % Ti-2 wy % Mo-10 wt % Co-reminder Ni) is shaped into a rod test specimen having an outer diameter of 15 mm and a length of 50 mm, onto which is formed a coating having a thickness of 300 μm by using the MCrAlX alloy (A, C, E, F, G) shown in Table 1 through the following spraying process.

① Composite sprayed coating of MCrAlX alloy according to the invention

The MCrAlX alloy containing an oxide (CoO, NiO, $Cr_2O_3$, $Al_2O_3$, $Y_2O_3$, addition amount: 2.0~4.0 wt %) is applied at a thickness of 300 μm through the low pressure plasma spraying process and then the MCrAlX alloy containing no oxide is applied thereonto at a thickness of 300 μm through the low pressure plasma spraying process so as to have a total thickness of 600 μm.

② MCrAlX alloy sprayed coating of Comparative Example

The same MCrAlX alloy as mentioned above (A, G) is applied at a thickness of 600 μm through the low pressure plasma spraying process.

B. Heating experimental method:

After the test specimen of the MCrAlX alloy sprayed coating is heated in an electric furnace at 1100° C.×8 h while flowing argon gas, the test specimen is cut to observe a diffusion state of alloy coating components into the Ni-based alloy by means of an optical microscope.

C. Results:

In Table 2 are summarized results measured on the depth of the diffusion layer into the Ni-based alloy substrate by the above heating experiment. As seen from these results, the diffusion layer of single phase coating formed by the low pressure plasma spraying process of the comparative examples (Test specimen Nos. 8, 9) reaches 87~88 μm, which shows a very diffusability.

On the contrary, the composite sprayed coating according to the invention (Test specimen Nos. 1~7) stop to a depth of 29~42 μm, from which it is understood that the oxide powder included in the undercoat controls the diffusion into the inside of the Ni-based alloy.

TABLE 1

| | Chemical composition (wt %) | | | | | |
|---|---|---|---|---|---|---|
| Symbol | Ni | Co | Cr | Al | Y | Ta |
| A | — | 63.4 | 23 | 13 | 0.6 | — |
| B | 76.5 | — | 17 | 6 | 0.5 | — |
| C | 67.0 | — | 22 | 10 | 1.0 | — |
| D | 70.6 | — | 23 | 6 | 0.4 | — |
| E | 77.2 | — | 16 | 6 | 0.8 | — |
| F | 32.0 | 38.5 | 21 | 8 | 0.5 | — |
| G | 10.0 | 52.8 | 25 | 7 | 0.6 | 5 |

TABLE 2

| | MCrAlX | Kind and amount of oxide added to MCrAlX alloy | | | | | Thickness of diffusion layer (μm) | |
|---|---|---|---|---|---|---|---|---|
| No. | alloy | CoO | NiO | $Cr_2O_3$ | $Al_2O_3$ | $Y_2O_3$ | 1100° C. × 8 h | Remarks |
| 1 | A | 0.2 | 0.3 | 0.3 | 0.4 | 0.8 | 42 | Acceptable Example |
| 2 | | — | — | — | 1.0 | 1.0 | 36 | |
| 3 | | — | — | — | 2.0 | — | 35 | |
| 4 | | — | — | — | — | 2.0 | 39 | |
| 5 | G | — | 0.5 | 1.5 | — | — | 44 | |
| 6 | | — | — | — | 1.0 | 1.0 | 39 | |
| 7 | | — | — | — | 2.0 | — | 29 | |
| 8 | A | — | — | — | — | — | 88 | Comparative Example |
| 9 | G | — | — | — | — | — | 87 | |

Note:
(1) Thickness of undercoat containing oxide powder is 300 μm.
(2) Thickness of topcoat containing no oxide powder is 300 μm.
(3) Each of undercoat and topcoat is formed through low pressure plasma spraying process.

Example 2

In this example, the adhesion properties of the coatings are examined by subjecting the composite sprayed coating of MCrAlX alloy according to the invention formed on the Ni-based alloy substrate used in Example 1 to a thermal shock test.

A. Test specimen:

① Composite sprayed coating of MCrAlX alloy according to the invention

As a substrate to be sprayed, a test piece of 30 mm in width×50 mm in length×5 mm in thickness is prepared from the Ni-based alloy of Example 1.

As a spraying material, a mixed powder of MCrAlX alloy (B, C, D, E, F) added with 0.8 wt % of $Al_2O_3$, $Y_2O_3$ or MgO is sprayed through a low pressure plasma spraying process to form an undercoat of 300 μm. And also, a part of the test specimens is subjected to Al diffusion treatment (900° C.×4 h) through powder process.

Onto the surface of the undercoat sprayed coating is formed a topcoat sprayed coating having a thickness of 300 μm by using the MCrAlX alloy containing no oxide powder through the low pressure plasma spraying process (total thickness 600 μm).

② MCrAlX alloy sprayed coating of Comparative Example

Onto the above Ni-based alloy substrate is formed the coating of the MCrAlX alloy containing no oxide at a thickness of 600 μm through the low pressure plasma spraying process.

b. Onto the above Ni-based alloy substrate is formed the coating having a thickness of 300 μm by using the same four kinds of MCrAlX alloy (A, B, C, D) through low pressure plasma spraying process.

B. Thermal shock test method:

An operation that the test specimen of the sprayed coating is heated in an electric furnace at 1000° C.×15 minutes and then charged into water of 25° C. as a one cycle is repeated 25 times to observe the appearance state of the test specimen.

C. Results:

The experimental results are shown in Table 3. As seen from this table, the alloy sprayed coatings of the comparative example (Nos. 13~17) show good resistance to thermal shock and do not show abnormal state in the appearance of the coating even after the 25 times repetition of the heating and water cooling. This is considered due to the fact that the coating formed by the MCrAlX alloy being dense through the low pressure plasma spraying process and good in the bonding force between particles strongly bonds to the substrate through the diffusion. In the coating of the comparative example, however, the layer considerably diffused into the inside of the substrate at a depth of 80~120 μm is observed and hence the strength of the diffused portion in the substrate is considerably degraded, On the contrary, the test specimens provided with the undercoat of MCrAlX alloy containing the oxide powder (No. 1~12) control the diffusion of the alloying components into the inside of the substrate and do not show abnormal state even in the thermal shock test of 25 times under the above test conditions and have been confirmed to have a good adhesion property. And also, the coatings after the Al diffusion treatment of the undercoat (No. 1, 5, 9, 12) show a good resistance to thermal shock.

TABLE 3

| No | MCrAlX alloy | Kind of oxide powder added | Al diffusion Treatment | Results of thermal shock test 1000° C. × 15 min/in water of 25° C. |
|---|---|---|---|---|
| | | Remarks | | |
| | | Acceptable Example | | |
| 1 | B | $Al_2O_3$ | presence | sound even after 25 times |
| 2 | | $Y_2O_3$ | absence | sound even after 25 times |
| 3 | | MgO | absence | sound even after 25 times |

TABLE 3-continued

| No | MCrAlX alloy | Kind of oxide powder added | Al diffusion Treatment | Results of thermal shock test 1000° C. × 15 min/in water of 25° C. |
|---|---|---|---|---|
| | | Remarks | | |
| 4 | C | $Al_2O_3$ | absence | sound even after 25 times |
| 5 | | $Y_2O_3$ | absence | sound even after 25 times |
| 6 | | MgO | absence | sound even after 25 times |
| 7 | D | $Al_2O_3$ | absence | sound even after 25 times |
| 8 | | $Y_2O_3$ | absence | sound even after 25 times |
| 9 | E | $Al_2O_3$ | absence | sound even after 25 times |
| 10 | | $Y_2O_3$ | absence | sound even after 25 times |
| 11 | F | $Al_2O_3$ | absence | sound even after 25 times |
| 12 | F | $Y_2O_3$ | presence | sound even after 25 times |
| | | Comparative Example | | |
| 13 | B | non | absence | sound even after 25 times |
| 14 | C | non | presence | sound even after 25 times |
| 15 | D | non | absence | sound even after 25 times |
| 16 | E | non | presence | sound even after 25 times |
| 17 | F | non | absence | sound even after 25 times |

Note:
(1) Amount of oxide powder added to MCrAlX alloy spraying material is as constant as 0.8 wt %.
(2) Conditions of Al diffusion treatment are 900 ° C. × 4 h.

Example 3

In this example, test for high-temperature corrosion and test for high-temperature sulfurization are made with respect to products obtained by forming the composite sprayed coating of MCrAlX alloy according to the invention onto Co-based alloy substrate, whereby the resistance to high-temperature environment is examined.

A. Test specimen:

① Composite sprayed coating of MCrAlX alloy according to the invention

A test specimen of 30 mm width×50 mm length×5 mm thickness is prepared by using the following Co-based alloy as a substrate to be sprayed.

Co-based alloy: 29.5 wt % Cr-10.5 wt % Ni-7.0 wt % W-2 wt % Fe-reminder Co

An undercoat of 300 μm in thickness is formed by using MCrAlX alloy (A, C) added with 1.0 wt % of $Al_2O_3$, $SiO_2$, $TiO_2$ or $ZrO_2$ as a spraying material through the low pressure plasma spraying process and a topcoat of 300 μm in thickness is formed on the undercoat sprayed coating by using the MCrAlX alloy containing no oxide powder (A, C) through the low pressure plasma spraying process. Further, there are provided products obtained by subjecting each of the undercoat and topcoat to Al diffusion treatment through powder process.

② Sprayed coating of MCrAlX alloy of Comparative Example a. A coating of 300 μm in thickness is formed on each of the above Ni-based alloy substrate and Co-based alloy substrate by using the MCrAlX alloys (A, C) through the atmospheric plasma spraying process.

b. There are provided products obtained by subjecting the sprayed coating of the above item a to the Al diffusion treatment under the same conditions as in the acceptable example of the invention.

B. High-temperature corrosion test method:

The high-temperature corrosion test method shown in Table 4 is carried out under the following conditions.

① Vanadium corrosion test: composition of chemical agents: 80% $V_2O_5$-20% NaCl temperature·time: 900°×3 h ② Test of high-temperature sulfurization corrosion: composition of chemical agents: 90% $Na_2SO_4$-10% NaCl temperature time: 1000° C.×4 h Moreover, the amount of the agents applied in both tests is 25 mg per 1 $cm^2$ of the sprayed coating (25 mg/$cm^2$), and the test specimen is maintained in an electric furnace at given temperature and time and taken out therefrom and thereafter the section of the coating corresponding to the corroded portion is observed by a microscope and the depth of the corrosion component penetrated is observed by an X-ray microanalyzer to examine the resistance to high-temperature corrosion in the coating.

C. Results:

In Table 4 are summarized the above test results for high-temperature corrosion. In the section of the atmospheric plasma sprayed coating of the comparative examples (No. 9, 10), corrosion components (V and S in vanadium corrosion, S and Cl in high-temperature sulfurization corrosion) very deeply penetrate into the inside of the coating (75~135 μm), while the penetration of the corrosion components stops to a range of 22~70 μm in the composite sprayed coatings according to the invention (No. 1~8), and the resistance to high-temperature corrosion is excellent.

On the other hand, in the coating of the comparative example (No. 9), the penetration depth is observed to be 2~3 times that of the composite sprayed coating according to the invention (No. 1) though it is subjected to the Al diffusion treatment, form which it is considered that the effect is less to the coating in which the surfaces of the spraying particles are covered with thin oxide film and gaps are existent between the particles as in the atmospheric plasma sprayed coating. In this point, it is considered that in the composite sprayed coating according to the invention, the oxide powder is included, but the content thereof is small, so that MCrAlX alloy particles being rich in the chemical activity are existent at a dense state and metallurgically reacts with Al in the Al diffusion treatment to form a more dense coating having an excellent corrosion resistance.

TABLE 4

| | | | Structure and thickness (μm) of coating | | | Penetration degree due to corrosion | | |
|---|---|---|---|---|---|---|---|---|
| | | | Kind of spraying process | | | | | |
| No. | MCrAlX alloy | Plasma spraying atmosphere | under-coat oxide | top-coat | Al diffusion Treatment | High-temperature corrosion Test | High-temperature sulfurization Test | Remarks |
| 1 | A | low | $Al_2O_3$ | absence | presence | 25–39 | 23–60 | Acceptable |
| 2 | | pressure | $SiO_2$ | presence | absence | 28–40 | 25–48 | Example |
| 3 | | (argon | $TiO_2$ | absence | absence | 22–55 | 20–61 | |
| 4 | | 50–200 | $ZrO_2$ | presence | presence | 22–57 | 32–55 | |
| 5 | C | hPa) | $Al_2O_3$ | presence | absence | 35–45 | 30–70 | |
| 6 | | | $SiO_2$ | absence | presence | 30–45 | 31–59 | |
| 7 | | | $TiO_2$ | presence | presence | 28–50 | 23–57 | |
| 8 | | | $ZrO_2$ | absence | absence | 35–68 | 40–65 | |
| 9 | A | air | none | absence | presence | 80–105 | 75–110 | Compara- |
| 10 | C | air | none | absence | absence | 95–130 | 80–135 | tive Example |

Note:
(1) Thickness of undercoat in test specimens No. 1–8 is 300 μm.
(2) Thickness of topcoat in test specimens No. 2, 4, 5, 7 is 300 μm.(No topcoat in test specimens No. 1, 3, 6, 8)
(3) Addition amount of oxide powder in the undercoat is 1.0 wt %.
(4) Coatings of test specimens No. 9 and 10 are formed at a thickness of 300 μm through atmospheric plasma spraying process.

Example 4

In this example, the thermal shock resistance is examined after $ZrO_2$ ceramic sprayed coating is formed on the topcoat sprayed coating.

A. Test specimen:

① Composite sprayed coating of MCrAlX alloy according to the invention

The coating according to the invention is prepared by the following process.

a. The undercoat having a thickness of 200 μm is formed on the same Ni-based alloy substrate as in Example 1 by using the MCrAlX alloy (D) containing oxides of 0.5 wt % $Y_2O_3$ and 0.5 wt % $Al_2O_3$ through the low pressure plasma spraying process.

b. The topcoat having a thickness of 300 μm is formed on the surface of the undercoat sprayed coating from the same MCrAlX alloy (D) through the low pressure spraying process.

c. $ZrO_2$ ceramic consisting of 8 wt % $Y_2O_3$-92 wt % $ZrO_2$ is applied onto the surface of the topcoat at a thickness of 300 μm through the atmospheric plasma spraying process.

② MCrAlX alloy sprayed coating of Comparative Example

As a comparative example, a test specimen of the coating is prepared by the following process.

a. As an undercoat, MCrAlX alloy (D) is applied at a thickness of 300 μm through the atmospheric plasma spraying process.

b. Onto the surface of the undercoat is applied $ZrO_2$ consisting of 8 % $Y_2O_3$-92 wt % $ZrO_2$ at a thickness of 300 μm through the atmospheric plasma spraying process.

B. Thermal shock test method:

An operation that the test specimen of the sprayed coating is heated in an electric furnace at 1000° C.×15 minutes and then charged into water of 25° C. as a one cycle is repeated 300 times to observe the appearance state of the test specimen.

C. Results:

As a result of the 300 times repetition of the heating and cooling, in the atmospheric plasma sprayed coating of the comparative example, many fine cracks are created in the ceramic layer and also the peeling of the coating of about 5 $mm^2$ is observed. On the contrary, the occurrence of fine crack is observed at only one place in the composite sprayed coating according to the invention, but the local peeling is not found and the coating is sound.

Industrial Applicability

As seen from the above explanations and the results of the examples, the composite sprayed coating of MCrAlX alloy consisting of the oxide sprayed coating and non-oxide sprayed coating according to the invention is small in the thickness of the diffusion layer into the inside of the member to be exposed even if the environment temperature becomes higher, so that it shows a good resistance to thermal shock and develops an excellent performance to the resistance to high-temperature corrosion. As a result, the member sprayed with MCrAlX alloy according to the invention is possible to be produced in a good productivity and a low cost by using the same kind of the spraying process and the same kind of metal in a field of gas turbine anticipating the rise of the temperature in future and hence it contributes to reduce the cost of power generation.

And also, the invention is suitable as a high temperature member used in a blast furnace, a heat treating furnace or the like, or a heat-resistant member used in rocket, space shuttle or the like.

What is claimed is:

1. A spray coated member for use in high temperature environment, wherein the spray coated member has a composite sprayed coating comprising an oxide-containing undercoat sprayed coating obtained by spraying a MCrAlX alloy spraying material (wherein M is one or more of Ni, Co and Fe, and X is one or more of Y, Hf, Ta, Cs, Pt, Ce, Zr, La, Si and Th) comprising at least one of CoO, NiO, $Cr_2O_3$, $Al_2O_3$, $Y_2O_3$, MgO, $SiO_2$, $ZrO_2$ and $TiO_2$ onto a surface of a heat-resistant alloy substrate under a low pressure and in the substantial absence of oxygen and a non-oxide topcoat sprayed coating obtained by spraying a MCrAlX alloy spraying material (wherein M is one or more of Ni, Co and Fe, and X is one or more of Y, Hf, Ta, Cs, Pt, Ce, Zr, La, Si and Th) onto the undercoat under a low pressure and in the substantial absence of oxygen.

2. A spray coated member according to claim 1, wherein a total amount of the oxide powder included in the undercoat sprayed coating is within a range of 0.2~20% by weight.

3. A spray coated member according to claim 1, wherein the undercoat sprayed coating and/or the topcoat sprayed coating has an Al diffused layer at its surface side.

4. A spray coated member according to claim 1, wherein the undercoat sprayed coating has a thickness within a range of 10~500 μm.

5. A spray coated member according to claim 1, wherein the topcoat sprayed coating has a thickness within a range of 100~800 μm.

6. A spray coated member according to claim 1, wherein the composite sprayed coating has a heat shielding layer made from an oxide ceramic formed on the surface of the topcoat sprayed coating.

7. A spray coated member according to claim 3, wherein the composite sprayed coating has a heat shielding layer made from an oxide ceramic formed on the surface of the topcoat sprayed coating.

8. A method of producing a spray coated member for use in high-temperature environment, wherein (1) an oxide-containing undercoat sprayed coating is formed by spraying a MCrAlX alloy material (wherein M is one or more of Ni, Co and Fe, and X is one or more of Y, Hf, Ta, Cs, Pt, Ce, Zr, La, Si and Th) comprising at least one of CoO, NiO, $Cr_2O_3$, $Al_2O_3$, $Y_2O_3$, MgO, $SiO_2$, $ZrO_2$ and $TiO_2$ onto a surface of a heat-resistant alloy substrate through a spraying process under a low pressure and in the substantial absence of oxygen, and (2) a non-oxide topcoat sprayed coating is formed thereon by spraying a MCrAlX alloy material (wherein M is one or more of Ni, Co and Fe, and X is one or more of Y, Hf, Ta, Cs, Pt, Ce, Zr, La, Si and Th) through a film-forming spraying process under a low pressure and in the substantial absence of oxygen to form the composite sprayed coating.

9. The method according to claim 8, wherein after the formation of the undercoat and the topcoat, Al diffusion treatment is further carried out on at least one or more layer thereof to increase the Al concentration in each surface layer portion.

10. The method according to claim 8, wherein a heat shielding layer is formed by spraying an oxide ceramic after the formation of the topcoat in the spraying formation of the composite sprayed coating.

11. The method according to claim 9, wherein a heat shielding layer is formed by spraying an oxide ceramic after the formation of the topcoat in the spraying formation of the composite sprayed coating.

12. A spray coated member according to claim 1, wherein the undercoat sprayed coating has a thickness within a range of 50–100 μm.

13. A spray coated member according to claim 1, wherein the topcoat sprayed coating has a thickness within a range of 200–500 μm.

14. A spray coated member according to claim 1, wherein the heat-resistant alloy substrate is Ni-based.

15. A spray coated member according to claim 1, wherein the heat-resistant alloy substrate is Co-based.

16. A spray coated member according to claim 1, wherein the heat-resistant alloy substrate is a gas turbine blade.

17. A spray coated member according to claim 1, wherein the composition of the MCrAlX alloy is as follows:

| | | | |
|---|---|---|---|
| M component: | Ni 0–75 wt % | Co 0–70 wt. % | Fe 0–30 wt % |
| Cr component: | 5–10 wt. % | | |
| Al component: | 1–29 wt. % | | |
| X component: | Y 0–5 wt. % | Hf 0–10 wt. %. | |

18. A spray coated member according to claim 2, wherein the particle size of the oxide powder is within the range of 0.1–50 μm.

19. A spray coated member for use in high temperature environment, wherein the spray coated member has a composite sprayed coating comprising an oxide-containing undercoat sprayed coating having a thickness within a range of 50–100 $\mu$m and obtained by spraying a MCrAlX alloy spraying material (wherein M is one or more of Ni, Co and Fe, and X is one or more of Y, Hf, Ta, Cs, Pt, Ce, Zr, La, Si and Th) comprising at least one of CoO, NiO, $Cr_2O_3$, $Al_2O_3$, $Y_2O_3$, MgO, $SiO_2$, $ZrO_2$ and $TiO_2$ in an amount of 2–20% by weight onto a surface of a heat-resistant alloy substrate under a low pressure and in the substantial absence of oxygen, and a non-oxide topcoat sprayed coating having a thickness within a range of 200–500 $\mu$m and obtained by spraying a MCrAlX alloy spraying material (wherein M is one or more of Ni, Co and Fe, and X is one or more of Y, Hf, Ta, Cs, Pt, Ce, Zr, La, Si and Th) onto the undercoat under a low pressure and in the substantial absence of oxygen.

20. A spray coated member according to claim 19, wherein at least one of the undercoat sprayed coating and the topcoat sprayed coating has an Al diffused layer at its surface side.

* * * * *